US006457959B2

(12) United States Patent
Nakane et al.

(10) Patent No.: US 6,457,959 B2
(45) Date of Patent: Oct. 1, 2002

(54) ANTI-ROTATION MECHANISM FOR MOVABLE SCROLL IN SCROLL COMPRESSOR

(75) Inventors: Yoshiyuki Nakane; Toshiro Fujii; Naoya Yokomachi; Shinya Yamamoto; Kazuo Murakami, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/846,938

(22) Filed: May 1, 2001

Related U.S. Application Data

(62) Division of application No. 09/349,307, filed on Jul. 8, 1999, now Pat. No. 6,287,096.

(30) Foreign Application Priority Data

Jul. 10, 1998 (JP) ..... 10-196230

(51) Int. Cl.[7] ..... F04C 18/04
(52) U.S. Cl. ..... 418/55.2; 418/55.3
(58) Field of Search ..... 418/55.2, 55.3

(56) References Cited

U.S. PATENT DOCUMENTS 4,522,574 A * 6/1985 Arai et al. ..... 418/55.3
4,731,000 A * 3/1988 Haag ..... 418/55.3
6,287,096 B1 * 9/2001 Nakane et al. ..... 418/55.2

FOREIGN PATENT DOCUMENTS

JP 58-30403 * 2/1983 ..... 418/55.3
JP 60-182382 * 9/1985 ..... 418/55.3

* cited by examiner

*Primary Examiner*—John J. Vrablik
(74) *Attorney, Agent, or Firm*—Morgan & Finnegan, LLP

(57) ABSTRACT

An improved scroll compressor having a movable scroll that orbits without being inclined. The compressor has a fixed scroll formed in the housing. The movable scroll is accommodated in the housing and mates with the fixed scroll. The movable scroll is driven by a drive shaft via a crank mechanism. A flange is formed at the periphery of the movable scroll and lies perpendicular to the drive shaft. A groove is formed in the housing. The groove is slightly wider than the thickness of the flange. The flange is slidably accommodated in the groove. Support holes extend in the housing. A pin is supported in each support hole. The ends of each pin are received in guide holes through the flange. Since engagement of the flange and the groove prevents the movable scroll from being inclined, the pin is maintained parallel to the guide holes and follows the wall of the guide holes. As a result, uneven wear of the pins and the guide holes is avoided.

2 Claims, 7 Drawing Sheets

ANTI-ROTATION MECHANISM FOR MOVABLE SCROLL IN SCROLL COMPRESSOR

This is a divisional of prior application Ser. No. 09/349,307, filed Jul. 8, 1999, U.S. Pat. No. 6,287,096, to which priority under 35 U.S.C. §120 is claimed.

BACKGROUND OF THE INVENTION

The present invention relates to scroll compressor for compressing gas.

FIG. 10 shows such a scroll compressor, which was disclosed in Japanese Unexamined Patent Publication No. 5-321850. The compressor includes a fixed scroll 52 formed in a center housing part 51. A drive shaft 56 is rotatably supported by a front housing part 55. The front housing part 55 and the center housing part 51 form a scroll housing for accommodating a movable scroll 53. A compression chamber 54 is defined between the movable scroll 53 and the fixed scroll 52. The movable scroll 53 is supported by a crank mechanism 56*a*. The crank mechanism 56*a* converts rotation of the drive shaft 56 into eccentric (orbital) movement of the movable scroll 53 relative to the drive shaft 56. Orbital movement of the movable scroll 53 causes the volume of the compression chamber 54 to change from the maximum to the minimum and then from the minimum to the maximum. As the volume of the compression chamber 54 is decreased, gas in the compression chamber 54 is compressed.

A compression reaction force generated by compressing gas acts on the rear face 55*a* of the front housing part 55. Guide holes 55*b* (only one is shown) are formed in the rear face 55*a*. Support holes 53*b* are formed in a base plate 53*a* of the movable scroll 53. A pin 57 is fitted in each support hole 53*b*. The distal end of each pin 57 is inserted into the corresponding guide hole 55*b*. Each pin 57, the corresponding hole 53*b* and the corresponding guide hole 55*b* form an anti-rotation mechanism. When rotation of the drive shaft 56 is transferred to the movable scroll 53 by the crank mechanism 56*a*, the anti-rotation mechanisms prevent the movable scroll 53 from rotating, while permitting the movable scroll 53 to orbit at a predetermined radius.

The diameter of the support holes 53*b* is slightly greater than the diameter of the pins 57 such that each pin 57 rotates in the corresponding support hole 53*b*. The pins 57 are supported by the movable scroll 53 in a cantilevered manner. Therefore, when receiving a radial force, each pin 57 is slightly inclined in the corresponding hole 53*b*. When the movable scroll 53 is orbiting, inclination of the pins 57 causes the load to concentrate at the open end of the hole 53*b*, which excessively wears the open end of the hole 53*b*. The wearing of the open end of the holes 53*b* causes the inclination of the pins 57 to increase. As a result, the orbit radius of the movable scroll 53 eventually exceeds the initial value. A greater orbit radius of the scroll 53 degrades the compression efficiency of the compressor. If the pins 57 are supported by the front housing part 55 and the guide holes are formed in the base plate 53*a*, the compressor will have the same problem.

In order to prevent the pin 57 from inclining, the proximal end of each pin 57 may be fixed within the corresponding support hole 53*b*, and a bearing may be fitted to the distal end of each pin 57. The outer surface of the bearing rolls on the wall of the guide hole 55*b*. This structure prevents the pins 57 from inclining relative to the movable scroll 53. Thus, the holes 53*b* are not unevenly worn. However, when the compressor is started, the movable scroll 53 is slightly inclined. At this time, each bearing unevenly contacts the open end of the corresponding guide hole 55*b*. This unevenly wears the bearings and the open end of the guide holes 55*b*, which eventually increases the orbit radius of the movable scroll 53. Accordingly, the compression efficiency of the compressor is lowered.

SUMMARY OF THE INVENTION

Accordingly, it is an objective of the present invention to provide a scroll compressor that improves the compression efficiency.

To achieve the foregoing and other objectives and in accordance with the purpose of the present invention, a scroll compressor for compressing gas is provided. The scroll compressor includes a housing having an annular groove that includes a pair of walls facing each other, a fixed scroll formed in the housing, a drive shaft rotatably supported in the housing, a movable scroll accommodated in the housing to mate with the fixed scroll and a crank mechanism. The crank mechanism is located between the drive shaft and the movable scroll for driving the movable scroll in accordance with the rotation of the drive shaft. A projection extends radially from the movable scroll along a plane perpendicular to the axis of the drive shaft. The projection is located in the annular groove and slides along the walls of the annular groove, and has a thickness measured in the axial direction of the drive shaft. The distance between the groove walls is greater than the thickness of the projection by a predetermined value. The scroll compressor further includes a restriction mechanism for inhibiting rotation of the movable scroll with respect to the axis of the movable scroll and for permitting orbital movement of the movable scroll. The restriction mechanism includes a restriction member supported by the projection or the groove walls.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A scroll compressor according to a first embodiment of the present invention will now be described with reference to FIGS. 1 to 4.

Figure 1:
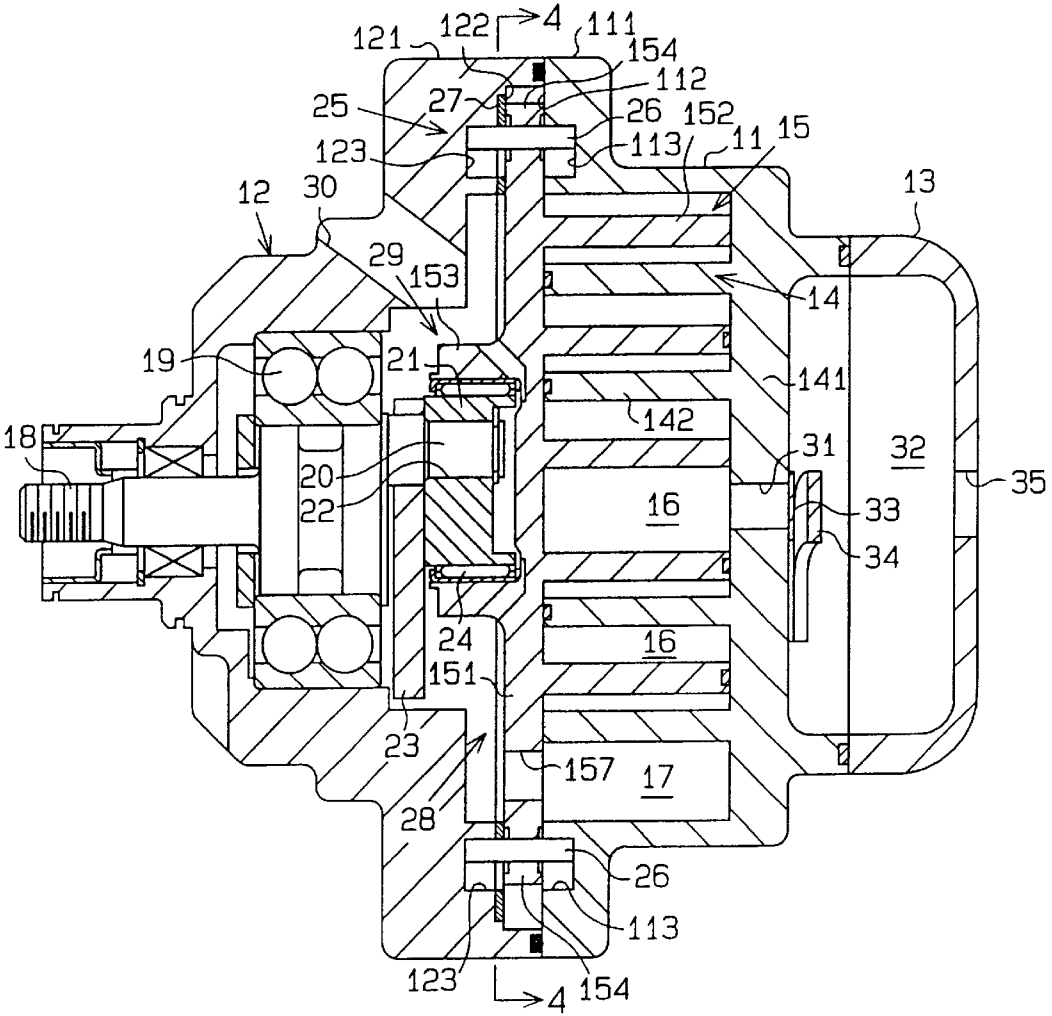
FIG. 1 is a cross-sectional view showing a scroll compressor according to a first embodiment of the present invention.
Figure 2:
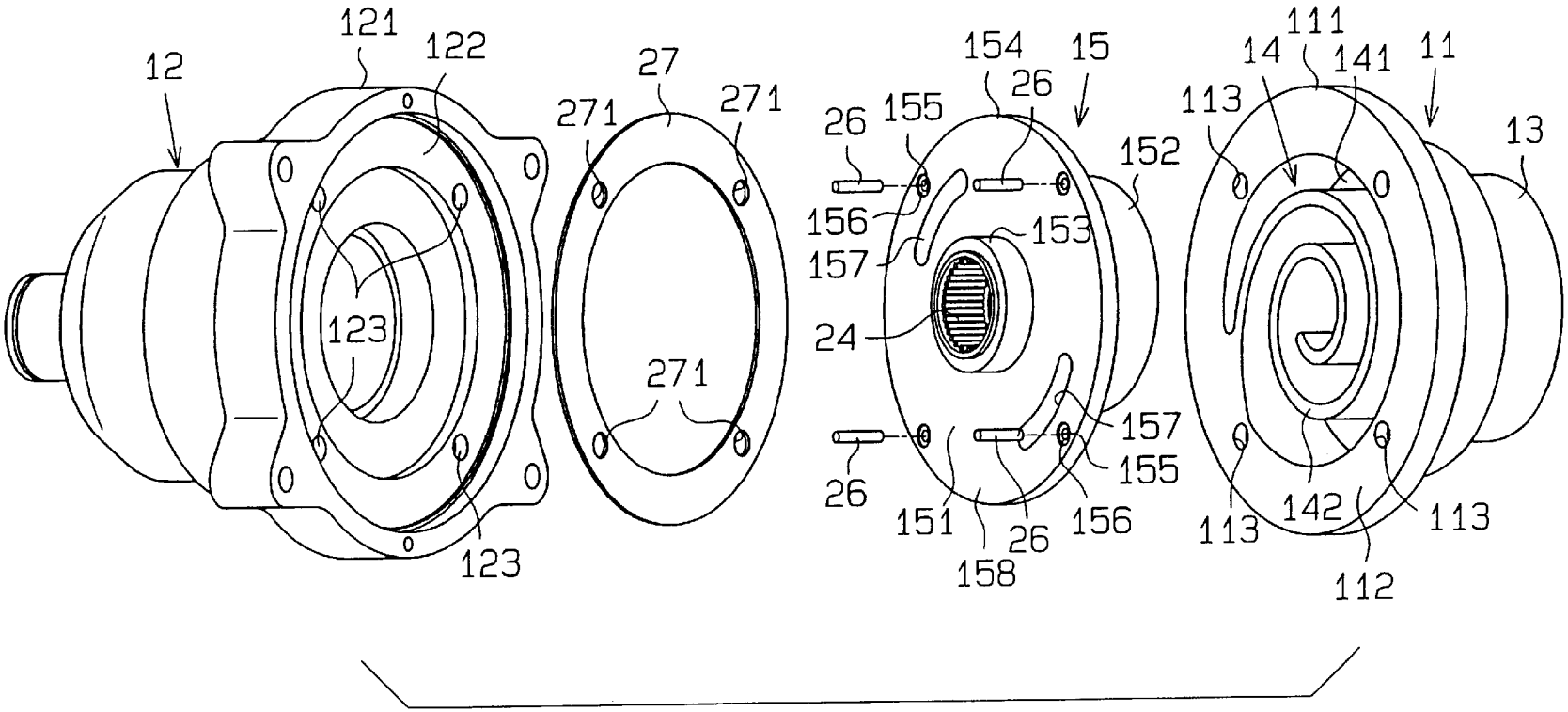
FIG. 2 is an exploded perspective view showing the compressor of FIG. 1.

As shown in FIG. 1, the scroll compressor includes a center housing part 11, a front housing part 12 and a rear housing part 13, which are made of aluminum alloy. The center housing part 11, the front housing part 12 and the rear housing part 13 are secured to one another by bolts (not shown). As shown in FIG. 2, a recess 122 is formed in the front housing part 12. A rim 111 is formed in the front end (left side as viewed in FIG. 1) of the center housing part 11. A rim 121 is formed in the rear end (right side as viewed in FIG. 1) of the front housing part 12. The rim 111 is secured to the rim 121. The rear housing part 13 is secured to the rear end of the center housing part 11.

A fixed scroll 14 is integrally formed with the center housing part 11 and includes a base plate 141 and a volute portion 142 protruding from the base plate 141. The front housing part 12 and the center housing part 11 accommodate a movable scroll 15. The movable scroll 15 includes a base plate 151, a volute portion 152 protruding from the rear side of the base plate 151, a boss 153 protruding from the front side of the base plate 151 and a radial projection, or flange 154. The flange 154 is integrally formed with the periphery of the base plate 151 such that the flange 154 lies in a plane perpendicular to the axis of the drive shaft 18. A compression chamber 16 is defined between the volute portion 152 of the movable scroll 15 and the volute portion 142 of the fixed scroll 14. An annular suction chamber 17 is defined between the volute portions 142, 152 and the inner wall of the center housing part 11. A crank chamber 28 is defined between the front housing part 12 and the base plate 151 of the movable scroll 15. A crank mechanism 29 is accommodated in the crank chamber 28. The crank mechanism 29 orbits the movable scroll 15.

Figure 4:
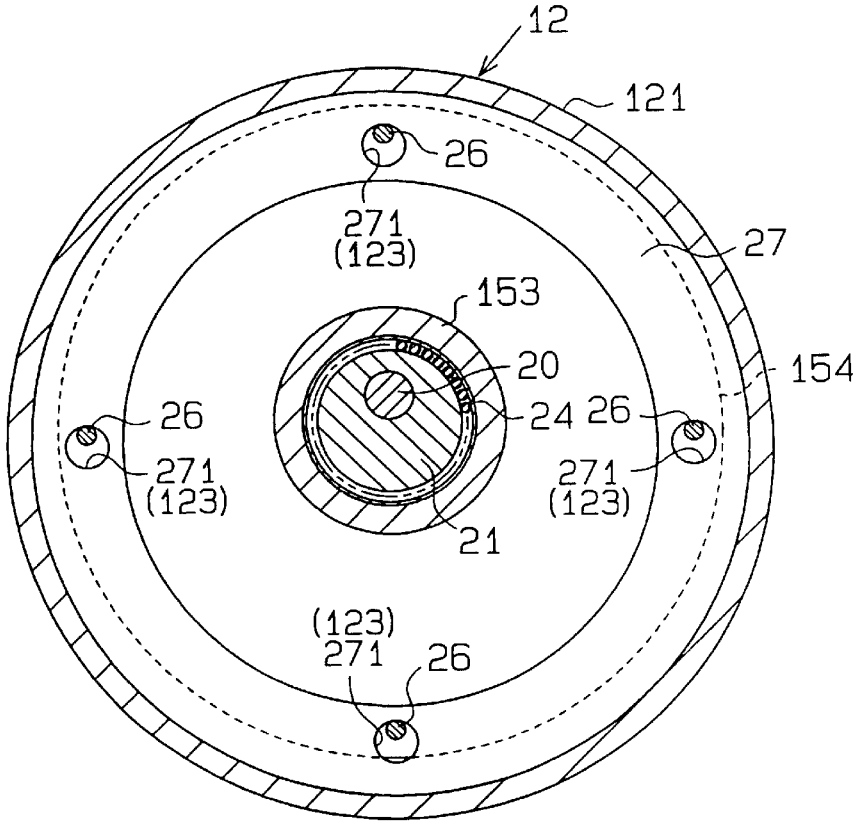
FIG. 4 is a cross-sectional view taken along line 4—4 of FIG. 1.

As shown in FIG. 1, the drive shaft 18 is rotatably supported by a bearing 19 in the front housing part 12. The crank mechanism 29 includes the drive shaft 18, a crank pin 20, a bushing 21 and a counter weight 23. As shown in FIGS. 2 and 4, the crank pin 20 extends rearward from the drive shaft 18 and is radially offset from the axis of the drive shaft 18. The bushing 21 has an eccentric hole 22. The bushing 21 is fitted in the boss 153 with a bearing 24. The distal end of the crank pin 20 is fitted in the eccentric hole 22. The counterweight 23 is integrally formed with the proximal end of the crank pin 20.

The structure of the anti-rotation mechanisms 25 (only one is shown) will now be described with reference to FIGS. 1 to 3. The anti-rotation mechanisms 25 permit the movable scroll 15 to orbit while prohibiting its rotation. As shown in FIG. 1, the recess 122 of the front housing part 12 and the front face 112 of the center housing part 11 define an annular groove. The axial dimension of the annular groove is slightly greater than that of the flange 154. Most of the flange 154 is located in the groove.

As shown in FIG. 2, four support holes 155 extend through the flange 154. The support holes 155 are equally spaced apart in the circumferential direction of the flange 154. A pin 26 is inserted in each support hole 155. The diameter of the pins 26 is slightly smaller than that of the support holes 155 so that each pin 26 is permitted to rotate. Four guide holes 113 are formed in the front face 112 of the center housing part 11. As shown in FIGS. 1 and 3, another four guide holes 123 are formed in the recess 122. Each pin 26 is loosely fitted in the corresponding pair of guide holes 113 and 123.

As shown in FIG. 2, an annular spacer 27 is located between the front end face 158 of the flange 154 and the front housing part 12. The compression reaction force acting on the movable scroll 15 is received by the front housing part 12 via the spacer 27. The spacer 27 has four through holes 271. The pins 26 are inserted in the through holes 271. The distance X (see FIG. 3) between the rear end face 159 of the flange 154 and the front face 112 of the center housing part 11 can be changed by altering the thickness of the spacer 27. In the embodiment of FIGS. 1 to 4, the distance X is 0.01 mm.

Figure 3:
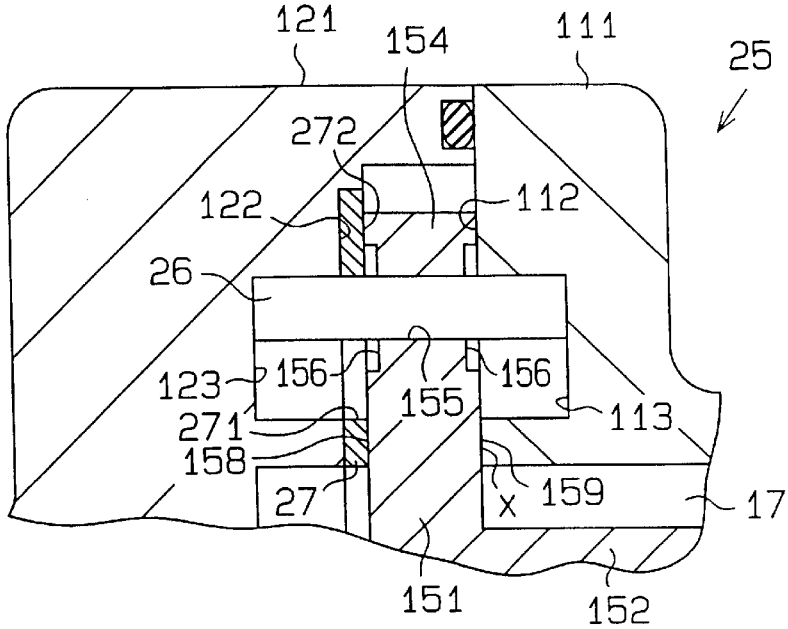
FIG. 3 is an enlarged partial cross-sectional view illustrating an anti-rotation mechanism.

As shown in FIG. 3, a recess 156 is formed about each support hole 155 on each face 158, 159 of the flange 154. That is, the support holes 155 are countersunk The recesses 156 facilitate the entry of atomized oil, which is dispersed in the refrigerant gas, into the support holes 155. When the drive shaft 18 rotates, engagement of the pins 26 and the guide holes 113, 123 prevents the movable scroll 15 from rotating while permitting the movable scroll 15 to orbit about the axis of the drive shaft 18. The orbit radius of the movable scroll 15 is calculated by subtracting the radius of the pin 26 from the radius of the guide holes 113, 123.

As shown in FIG. 1, an inlet 30 is formed in the front housing part 12. The inlet 30 is connected to an external refrigerant circuit (not shown). Refrigerant gas is drawn into the crank chamber 28 through the inlet 30. As shown in FIGS. 1 and 2, suction passages 157 are formed in the flange 154 to conduct refrigerant gas in the crank chamber 28 to the suction chamber 17. A discharge port 31 is formed in the center of the base plate 141 of the fixed scroll 14 to communicate the compression chamber 16 with a discharge chamber 32 formed in the rear housing part 13. A discharge valve flap 33 is located at the outer end of the discharge port 31. A stopper 34 limits the opening amount of the discharge valve flap 33. An outlet 35 is formed in the rear housing part 13. Pressurized gas in the discharge chamber 32 is discharged to the external refrigerant circuit through the outlet 35.

The operation of the scroll compressor will now be described.

When the drive shaft 18 is rotated, the crank pin 20, the bushing 21 and the bearing 24 causes the movable scroll 15 to orbit about the axis of the drive shaft 18 without rotating the scroll 15. Orbital movement of the scroll 15 draws refrigerant gas into the suction chamber 17 through the inlet 30, the crank chamber 28 and the suction passage 157. The refrigerant gas flows from the suction chamber 17 to the compression chamber 16 along the volute portions 142, 152. The orbiting movement of the movable scroll 15 moves the gas along the volute portions 142, 152 toward the center of the compression chamber 16, while gradually compressing the gas. The compressed gas pushes open the discharge valve flap 33 and flows into the discharge chamber 32 through the discharge port 31. The gas is then supplied to the external refrigerant circuit through the outlet 35.

The scroll compressor of FIGS. 1 to 4 has the following advantages.

(1) The flange 154 formed on the movable scroll 15 lies in a plane perpendicular to the axis of the drive shaft 18.

The flange 154 is located between the center housing part 11 and the front housing part 12, and the distance X exists between the flange 154 and the center housing part 11. The mid-section of each pin 26 engages the flange 154, and the ends of each pin 26 are loosely fitted in the corresponding guide holes 113, 123. This construction permits the movable scroll 15 to orbit without rotating. When the movable scroll 15 is orbiting, the forces act evenly on the parts of each pin 26 that engage the guide holes 113, 123 which prevents the open ends of the corresponding support hole 155 from being worn excessively. As a result, the orbit radius of the movable scroll 15 is not increased and the compression efficiency of the compressor is not lowered. The durability of the compressor is also improved.

(2) The compression reaction force urges the flange 154 to the left as viewed in FIG. 3, which creates a space between the rear end face 159 of the flange 154 and the front face 112 of the center housing part 11. However, the spacer 27 maintains the space X between the rear face 159 of the flange 154 and the front face 112 of the center housing 10 part 11 at a relatively narrow dimension (0.01 mm). This prevents the movable scroll 15 from being inclined, particularly when the movable scroll 15 starts orbiting. As a result, the movable scroll 15 is started smoothly and operates smoothly thereafter.

(3) Dimensional tolerances in measurement and assebly of the compressor cause the distance X to vary. The variations of the distance X result in variations of characteristics of manufactured compressors. However, the variations of the distance X are compensated for by simply changing the thickness of the spacer 27, which is located between the recess 122 and the flange 154. Accordingly, variations of characteristics of manufactured compressors are eliminated. The spacer 27 may be made of a material having a high wear resistance such as stainless steel, and the flange 154 may be made of aluminum alloy. This prevents engaging surfaces of the spacer 27 and the flange 154 from being easily worn, thereby improving the durability of the compressor.

(4) The recesses 156 are formed about the ends of each support hole 155. The recesses 156 allow refrigerant gas containing atomized oil to easily enter between the support hole 155 and the pin 26. As a result, the pin 26 smoothly slides on the inner wall of the support hole 155, which prevents the pin 26 and the support hole 155 from wearing.

(5) The flange 154 is integrally formed with the movable scroll 15, which facilitates the manufacture.

A scroll compressor according to a second embodiment will now be described with reference to FIG. 5. The differences from the embodiment of FIGS. 1 to 4 will mainly be discussed below.

In the second embodiment, front support holes 12*a* are formed in the front housing part 12 and corresponding rear support holes 11*a* are formed in the center housing part 11. Guide holes 15*a* are formed in the movable scroll 15. Each pin 26 extends through one of the guide holes 15*a* and is supported by the corresponding front and rear support holes 12*a,* 11*a*. Therefore, the axial center of each pin 26 engages the wall of the associated guide hole 15*a,* and the ends of each pin 26 are supported by the corresponding support holes 11*a,* 12*a*. The diameter of each guide hole 15*a* is greater than the diameter of the pins 26. The orbit path of the movable scroll 15 is defined by contact between the guide pins 26 and the guide holes 15*a*.

Figure 5:
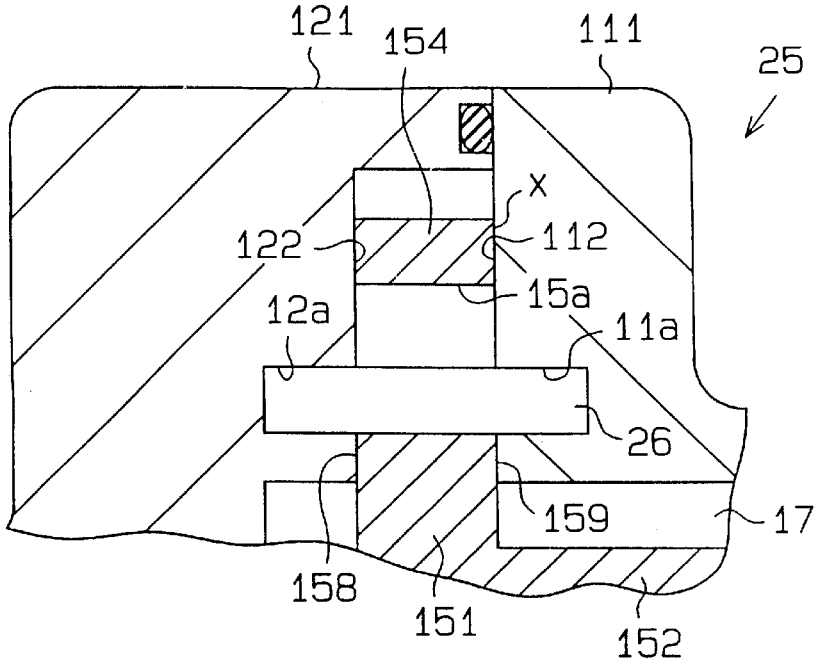
FIG. 5 is an enlarged partial cross-sectional view illustrating a an anti-rotation mechanism according to a second embodiment.

The construction of FIG. 5 prevents the pins 26 from inclining when the movable scroll 15 orbits. Therefore, neither the support holes 11*a,* 12*a* nor the guide holes 15*a* are worn near their openings, which prevents the orbit radius of the movable scroll 15 from increasing. As a result, the compression efficiency of the compressor will not degrade. Further, the construction of FIG. 5 smoothly orbits the movable scroll 15. The embodiment of FIG. 5 has the advantages (2) to (5) of the embodiment of FIGS. 1 to 4.

Figure 6:
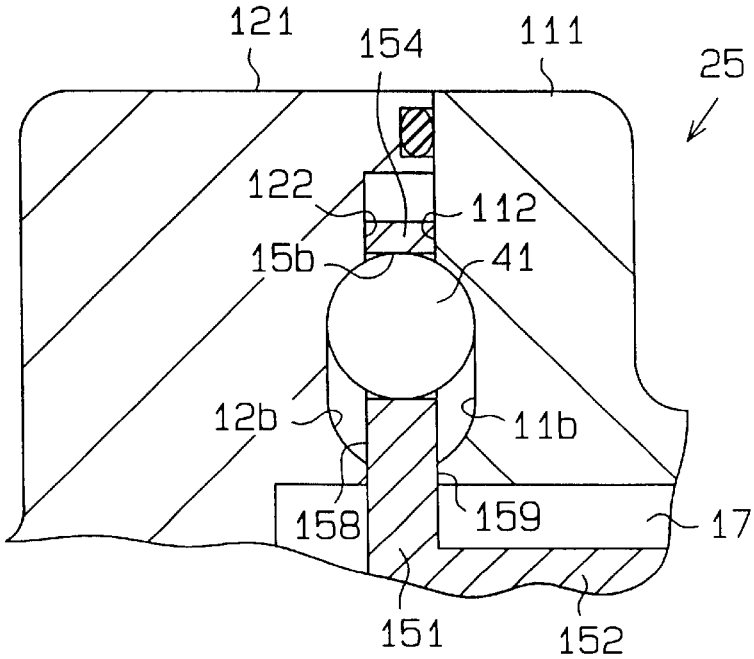
FIG. 6 is an enlarged partial cross-sectional view illustrating a an anti-rotation mechanism according to a third embodiment.

A scroll compressor according to a third embodiment will now be described with reference to FIG. 6. The differences from the embodiment of FIGS. 1 to 4 will mainly be discussed below. In the embodiment of FIG. 6, anti-rotation mechanisms 25 (only one is shown) are located between the front housing part 12 and the center housing part 11. The construction of the anti-rotation mechanism 25 of FIG. 6 is similar to that of a ball bearing. The mechanism 25 includes a flange 154, a support hole 15*b,* a ball 41 and guide holes 11*b,* 12*b*. The support hole 15*b* is formed in the flange 154 for rotatably accommodating the ball 41. The ball 41 is located between the guide hole 11*b* formed in the center housing part 11 and the guide hole 12*b* formed in the front housing part 12. The guide holes 11*b,* 12*b* have concave surfaces corresponding to the shape of the ball 41. The mid-section of the ball 41 is supported by the flange 154, while the ends of the ball 41 engage the guide holes 11*b,* 12*b*.

When the movable scroll 15 orbits, forces act evenly on the walls of the guide holes 11*b,* 12*b* via the ball 41. This prevents the support hole 15*b* and guide holes 11*b,* 12*b* from being unevenly worn. Further, the embodiment of FIG. 5 has the advantages (2) to (5) of the embodiment of FIGS. 1 to 4.

Figure 7:
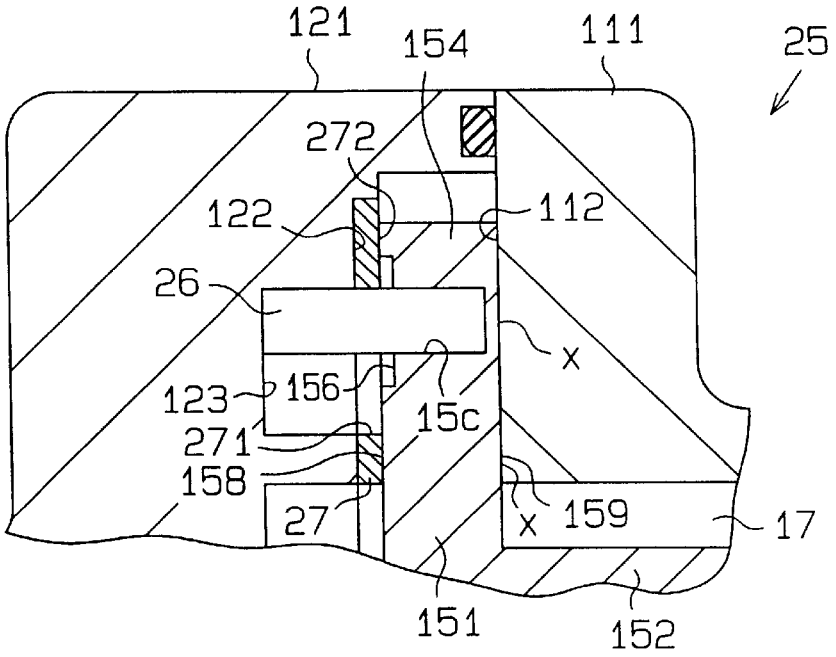
FIG. 7 is an enlarged partial cross-sectional view illustrating a an anti-rotation mechanism according to a fourth embodiment.

A scroll compressor according to a fourth embodiment will now be described with reference to FIG. 7. The differences from the embodiment of FIGS. 1 to 4 will mainly be discussed below. In the embodiment of FIG. 7, the rear guide holes 113 shown in FIGS. 1 to 4 are omitted. Blind support holes 15*c* are formed in the flange 154. One end of each pin 26 is inserted in one of the support holes 15*c*. The other end of the pin 26 is inserted into the guide hole 123. The outer surface of each pin 26 is parallel to the wall of the corresponding guide hole 123. The distance X between the front face 112 of the rim 111 and the flange 154 is 0.01 mm, as in the embodiment of FIGS. 1 to 4. Therefore, the flange 154, which is located between the housings 11, 12, lies in a plane perpendicular to the drive shaft 18. The movable scroll 15 is prevented from inclining relative to the plane.

The construction of FIG. 7 prevents the flange 154 (the movable scroll 15) from inclining when the movable scroll 15 orbits. Thus, the pins 26 are not inclined relative to the inner surface of the guide holes 123. Therefore, the construction of FIG. 7 prevents the support holes 15*c* and the guide holes 123 from being unevenly worn. As a result, the orbit radius of the movable scroll 15 is not increased and the compression efficiency does not degrade. Further, the construction of FIG. 7 allows the movable scroll 15 to smoothly orbit. Also, the embodiment of FIG. 7 has the advantages (3) to (5) of the embodiment of FIGS. 1 to 4.

Figure 8:
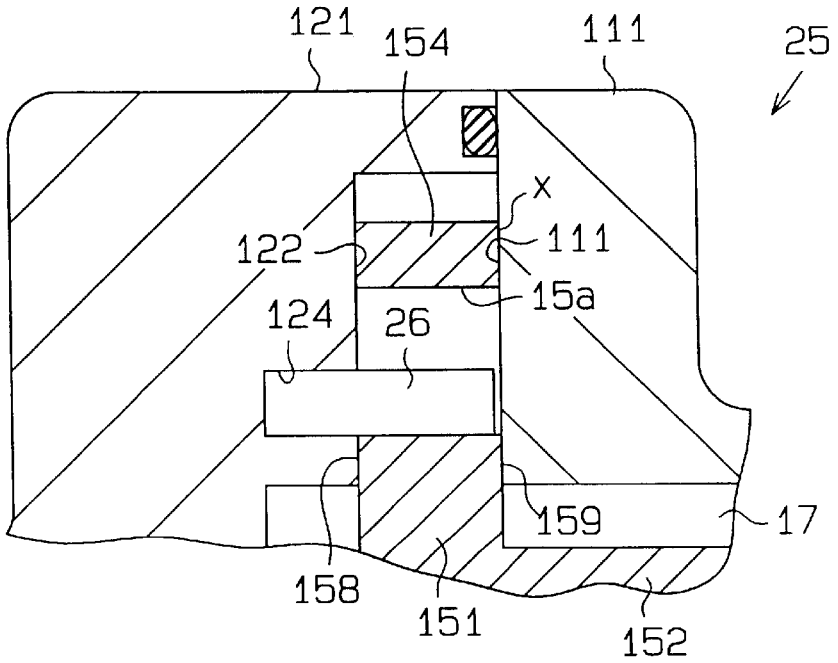
FIG. 8 is an enlarged partial cross-sectional view illustrating a an anti-rotation mechanism according to a fifth embodiment.

A scroll compressor according to a fifth embodiment will now be described with reference to FIG. 8. The differences from the embodiment of FIG. 5 will mainly be discussed below. In the embodiment of FIG. 8, the rear support holes 11*a* shown in FIG. 5 are omitted. Each pin 26 is supported by a support hole 124 formed in the front housing part 12. The outer surface of each pin 26 is parallel to the inner surface of the corresponding guide hole 15*a*. The distance X between the front face 112 of the rim 111 and the flange 154 is 0.01 mm, as in the embodiment of FIGS. 1 to 4. Therefore, the flange 154, which is located between the housings 11, 12, lies in a plane perpendicular to the drive shaft 18. The movable scroll 15 is prevented from inclining relative to the plane.

The construction of FIG. 8 prevents the flange 154 (the movable scroll 15) from inclining when the movable scroll 15 orbits. Therefore, each support hole 124 and each guide hole 15*a* are prevented from being unevenly worn. As a result, the orbit radius of the movable scroll 15 is not increased, and the compression efficiency is not lowered. Further, the construction of FIG. 8 allows the movable scroll 15 to smoothly orbit.

The embodiment of FIG. 8 has the advantages (3) to (5) of the embodiment of FIGS. 1 to 4.

Although only five embodiments of the present invention have been described herein, it should be apparent to those skilled in the art that the present invention may be embodied in many other specific forms without departing from the spirit or scope of the invention. Particularly, it should be understood that the invention may be embodied in the following forms.

In the embodiment of FIGS. 1 to 4, each pins 26 may be fixed to the flange 154 and bearings may be fitted to the ends of the pin 26. The bearings roll along the walls of the guide holes 113, 123. This construction prevents the pin 26 from inclining relative to the inner surfaces of the guide holes 113, 123. Therefore, uneven wear of the guide pins 26 and the guide holes 113, 123 is prevented.

In the embodiment of FIG. 5, bearings may be located between the outer surface of each pin 26 and the inner surfaces of the support holes 11*a*, 12*a*. Alternatively, a bearing may be located between each guide pin 26 and the corresponding guide hole 15*a*.

Figure 9:
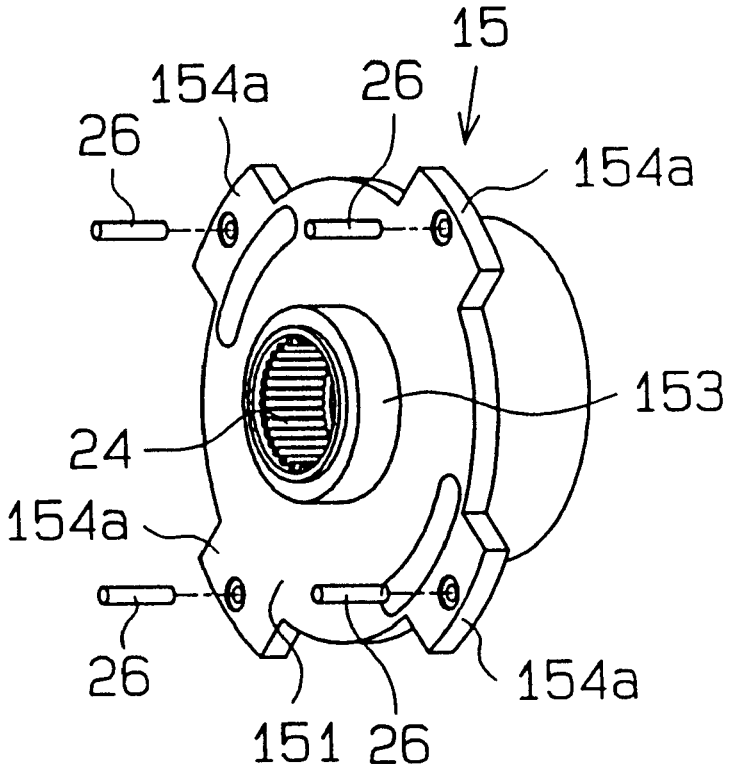
FIG. 9 is a perspective view showing a movable scroll according to another embodiment.
Figure 10:
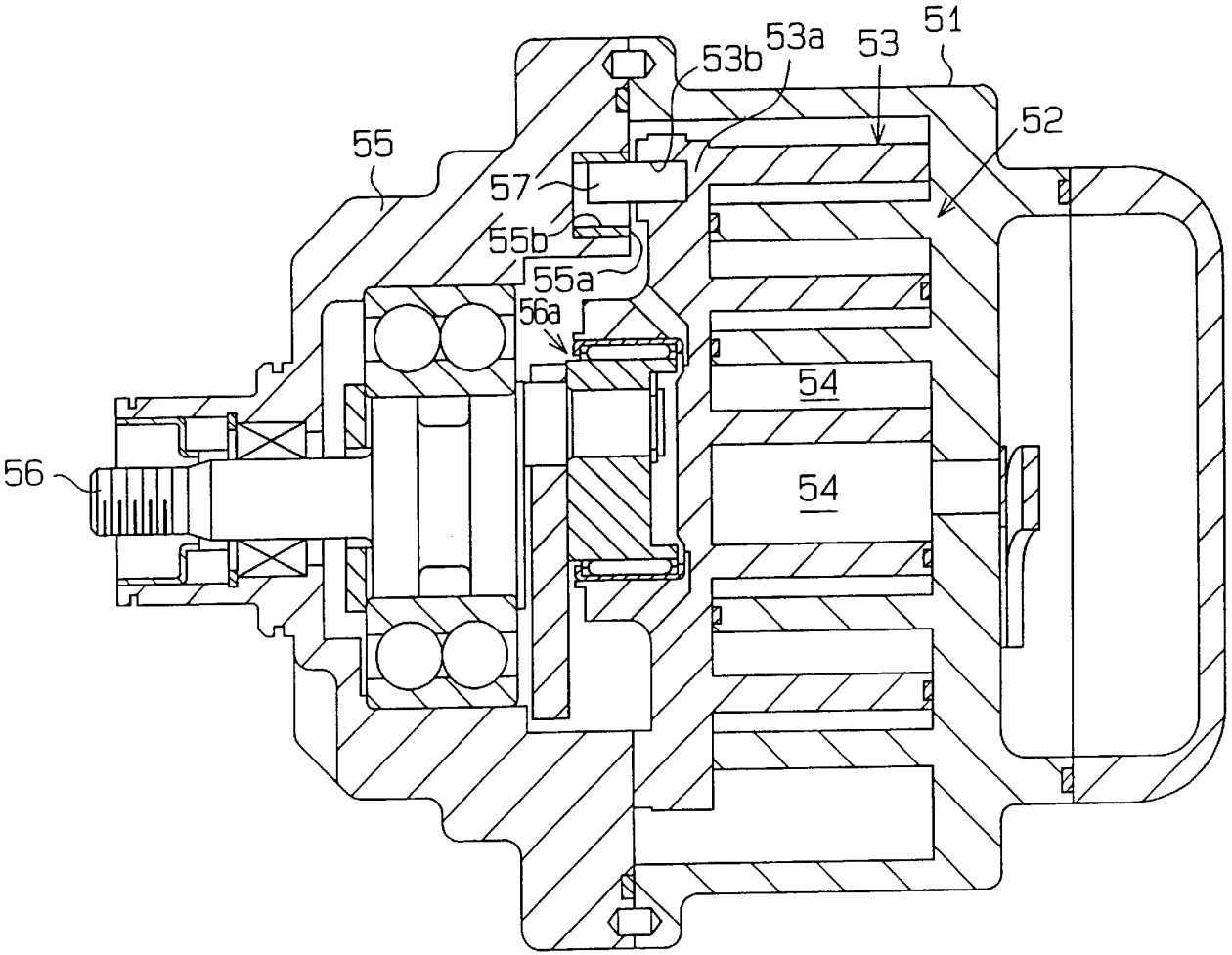
Fig.10(Prior Art)
FIG. 10 is a cross-sectional view illustrating a prior art scroll compressor.

The shape of the flange 154 may be altered. For example, as shown in FIG. 9, the flange 154 may be replaced by projections 154*a* extending radially from the base plate 151 of the movable scroll 15.

The flange 154 may be made of material different from that of the base plate 151. In this case, the flange 154 may be integrated with the base plate 151 by insert molding.

The distance X may be changed between 0.01 mm and 0.2 mm.

The number of the anti-rotation mechanisms 25 may be arbitrarily determined.

Therefore, the present examples and embodiments are to be considered as illustrative and not restrictive and the invention is not to be limited to the details given herein, but may be modified within the scope and equivalence of the appended claims.

What is claimed is:

1. A scroll compressor for compressing gas comprising:

a housing having an annular groove that includes a pair of walls facing each other;

a fixed scroll formed in the housing;

a drive shaft rotatably supported in the housing;

a movable scroll accommodated in the housing to mate with the fixed scroll;

a crank mechanism located between the drive shaft and the movable scroll for driving the movable scroll in accordance with the rotation of the drive shaft:

a projection extending radially from the movable scroll along a plane perpendicular to the axis of the drive shaft, wherein the projection is located in the annular groove and slides along the walls of the annular groove, wherein the projection has a thickness measured in the axial direction of the drive shaft, and wherein the distance between the groove walls is greater than the thickness of the projection by a predetermined value; and a restriction mechanism for inhibiting rotation of the movable scroll with respect to the axis of the movable scroll and for permitting orbital movement of the movable scroll, the restriction mechanism includes a pin, the pin has ends, the housing further having a support hole formed in one of the groove walls to support the pin, and a guide hole formed in the projection to correspond to the support hole to loosely fit the pin, the guide hole has an inner diameter greater than that of the support hole so that the pin orbits within the guide hole by contacting an inner periphery surface of the guide hole while remaining parallel to the drive shaft, wherein the support hole is formed in one of the groove walls, and the guide hole is a through hole formed in the projection to correspond to the support hole, wherein one end of the pin is supported by the support hole, undo wherein the other end of the pin is loosely fitted in the glide hole.

2. A scroll compressor for compressing gas comprising:

a housing having an annular groove that includes a pair of walls facing each other;

a fixed scroll formed in the housing;

a drive shaft rotatably supported in the housing;

a movable scroll accommodated in the housing to mate with the fixed scroll;

a crank mechanism located between the drive shaft and the movable scroll for driving the movable scroll in accordance with the rotation of the drive shaft;

a projection extending radially from the movable scroll along a plane perpendicular to the axis of the drive shaft, wherein the projection is located in the annular groove and slides along the walls of the annular groove, wherein the projection has a thickness measured in the axial direction of the drive shaft, and wherein the distance between the groove walls is greater than the thickness of the projection by a predetermined value; and a restriction mechanism for inhibiting rotation of the movable scroll with respect to the axis of the movable scroll and for permitting orbital movement of the movable scroll, the restriction mechanism includes a pin, the pin has ends, the housing further having a support hole formed in one of the groove walls to support the pin, and a guide hole formed in the projection to correspond to the support hole to loosely fit the pin, the guide hole has an inner diameter greater than that of the support hole so that the pin orbits within the guide hole by contacting an inner periphery surface of the guide hole while remaining parallel to the drive shaft, wherein the support hole includes a first support hole formed in one of the groove walls and a second support hole formed in the other groove wall, and the guide hole is a through hole formed in the projection to correspond to the support hole, wherein the ends of the pin are supported by the support holes, and wherein a mid-section of the pin is loosely fitted in the guide hole.

* * * * *

UNITED STATES PATENT AND TRADEMARK OFFICE

CERTIFICATE OF CORRECTION

PATENT NO. : 6,457,959 B2
DATED : October 1, 2002
INVENTOR(S) : Nakane et al.

It is certified that error appears in the above-identified patent and that said Letters Patent is hereby corrected as shown below:

Title page,
Item [57], ABSTRACT,
Lines 10-11, please delete "Support holes extend in the housing" and insert therefore
-- Support holes extend through the flange --;
Line 12, please delete "guide holes through the flange." and insert therefore
-- guide holes. --.

Column 5,
Line 22, please delete "center housing 10 part 11" and insert therefore
-- center housing part 11 --.

Signed and Sealed this

Eighteenth Day of February, 2003

JAMES E. ROGAN
*Director of the United States Patent and Trademark Office*